US006500036B1

(12) United States Patent
Fukuoka et al.

(10) Patent No.: US 6,500,036 B1
(45) Date of Patent: Dec. 31, 2002

(54) OUTBOARD MOTOR POWER HEAD

(75) Inventors: Yoshihito Fukuoka, Hamamatsu (JP); Kazuyuki Kitajima, Hamamatsu (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/614,031

(22) Filed: Jul. 11, 2000

(30) Foreign Application Priority Data

Jul. 16, 1999 (JP) ..... 11-203806
Jul. 16, 1999 (JP) ..... 11-203807
Jul. 19, 1999 (JP) ..... 11-205343

(51) Int. Cl.[7] ..... B63H 5/20; B63H 21/21
(52) U.S. Cl. ..... 440/53; 440/84
(58) Field of Search ..... 440/53, 76, 77, 440/84, 88, 89

(56) References Cited

U.S. PATENT DOCUMENTS 3,570,465 A 3/1971 Masaoka
4,721,485 A 1/1988 Suzuki
4,832,641 A * 5/1989 Oishi et al. ..... 440/88
5,011,442 A * 4/1991 Polcz et al. ..... 440/113
5,129,377 A 7/1992 Taska
5,150,673 A 9/1992 Hoshiba et al.
5,180,320 A * 1/1993 Calamia et al. ..... 440/61
5,186,133 A 2/1993 Watanabe et al.
5,203,292 A 4/1993 Motose
5,261,356 A 11/1993 Takahashi et al.
5,537,964 A 7/1996 Hoshiba
5,551,385 A 9/1996 Yoshida et al.
5,586,535 A * 12/1996 Syomura ..... 123/352
5,755,606 A * 5/1998 Takahashi et al. ..... 440/84
5,765,519 A 6/1998 Watanabe
5,809,974 A 9/1998 Osakabe
5,827,455 A 10/1998 Nakai
5,832,888 A * 11/1998 Griffiths et al. ..... 123/179.18
5,868,118 A * 2/1999 Yoshioka ..... 123/494
5,951,344 A * 9/1999 Tsunoda et al. ..... 440/89
6,039,012 A * 3/2000 Motoyama ..... 123/65 PE
6,168,484 B1 * 1/2001 Mishima et al. ..... 440/88
6,257,940 B1 * 7/2001 Dunham et al. ..... 440/77

OTHER PUBLICATIONS

European Search Report.
Copending Patent Application No. 09/491359, filed Jan. 26, 2000 (Attorney Docket No. SANSH5.333A).

* cited by examiner

*Primary Examiner*—S. Joseph Morano
*Assistant Examiner*—Andrew Wright
(74) *Attorney, Agent, or Firm*—Knobbe, Martens, Olson & Bear, LLP

(57) ABSTRACT

A power head for an outboard motor includes an improved construction that can includes a compactly arranged tilt relay unit of a hydraulic tilt and trim system. The outboard motor includes a drive unit comprising an internal combustion engine. A bracket assembly is adapted to be mounted on an associated watercraft. The bracket supports the drive unit for pivotal movement about a generally horizontally extending tilt axis. A hydraulic tilt system is arranged to tilt up and down the drive unit. The tilt system includes a hydraulic pump and an electric motor actuating the hydraulic pump. A tilt relay unit supplies electric power to the electric motor based upon a control signal. The relay unit is disposed generally between the engine and the bracket assembly.

10 Claims, 5 Drawing Sheets

OUTBOARD MOTOR POWER HEAD

PRIORITY INFORMATION

This invention is based on and claims priority to Japanese Patent Application Nos. Hei 11-203806, filed Jul. 16, 1999, Hei 11-203807, filed Jul. 16, 1999 and Hei 11-205343, filed Jul. 19, 1999, the entire contents of which are hereby expressly incorporated by reference.

BACKGROUND OF THE INVENTION

1. Field of the Invention

The present invention generally relates to a power head of an outboard motor. More particularly, the present invention relates to an improved arrangement of engine equipment.

2. Description of Related Art

A typical outboard motor comprises a drive unit and a bracket assembly. The drive unit primarily includes a power head, a driveshaft housing and a lower unit. The power head incorporates an internal combustion engine surrounded by a protective cowling. The driveshaft housing depends from the power head and supports a driveshaft that is driven by an output shaft of the engine. The lower unit depends from the driveshaft housing and carries a propulsion device such as a propeller. The propeller is attached to a propulsion shaft that is driven by the driveshaft. The propulsion shaft extends through at least a portion of the lower unit.

The bracket assembly normally comprises a swivel bracket and a clamping bracket. The swivel bracket supports the drive unit for pivotal movement about a generally vertically extending steering axis. The clamping bracket is mounted on an associated watercraft and supports the swivel bracket for pivotal movement of the outboard motor and the attached swivel bracket about a generally horizontally extending tilt axis.

The bracket assembly can include a hydraulic tilt and trim system that is provided between the swivel bracket and the clamping bracket to tilt the drive unit up and down about the tilt axis and also to adjust a trim position of the drive unit. The trim position affects the angle of attack of the propulsion device (i.e., the propeller) within the body of water in which the outboard motor is being operated. The hydraulic tilt system has a hydraulic pump that is usually actuated by an electric motor. The electric motor requires a tilt relay unit that supplies electric power to the motor from a power source such as a generator or a battery. The relay unit generally is relatively large.

The relay uniforms but one of a number of electrical components used in internal combustion powered engines. These electrical components are supplied with power from a battery, a generator or a combination of the two components. Each of the circuits supplying the power generally pass through at least one fuse to reduce the likelihood that a current spike flowing through the electric circuit will damage the electrical components. In the event a fuse blows, the fuse must be replaced for proper operation of the electrical components. For this purpose, a fuse puller often is provided within the confines of the outboard motor. For instance, the fuse puller can be mounted in an electrical equipment case in which the fuse puller is concealed from normal viewing. Thus, the user or service person may have search for the concealed fuse puller, which searching increasing servicing time and increases the frustration of a casual watercraft operator that simply needs to replace a fuse without a great deal of technical watercraft knowledge.

SUMMARY OF THE INVENTION

The engine is surrounded by the protective cowling assembly as noted above. As can be appreciated, the size and configuration of the outboard motor, which is often determined by the sizing of this cowling assembly, affects handling of the associated watercraft, among other things. For instance, an unduly wide outboard motor increases air resistance during movement of the watercraft through the water. However, the interior of the cowling assembly could be a suitable place for mounting the tilt relay unit because of the enclosed compartment that it forms. In other words, the tilt relay unit can be well-protected from splashing water by mounting the tilt relay within the cowling assembly.

On the other hand, positioning the rather large tilt relay unit within the cowling would seemingly increase the size of the power head, which preferably is as small as possible for the reasons discussed above. Placement of the tilt relay unit within the current cowling adjacent the current engine configuration would appear to be difficult because the reduced power head size results in minimal free space between an outer surface of the engine and an inner surface of the cowling assembly.

A need therefore exists for an improved outboard motor construction that can be provided with a tilt relay unit of a hydraulic tilt and trim system in good arrangement balance. In outboard motors featuring counter-flow engine configurations (i.e., those featuring an air intake passage and exhaust passage that communicate with a combustion chamber on the same side of the engine), another need exists for an improved outboard motor construction that better structures the components along the engine surfaces such that voids between the engine and the cowling can be reduced. For instance, the relatively empty space defined in the side of the engine opposite the intake and exhaust passages can be significantly reduced. A further need exists for an improved outboard motor construction that accommodates a fuse puller in a readily accessible and/or visible location In accordance with one aspect of the present invention, an outboard motor comprises a drive unit and a bracket assembly. The drive unit has an internal combustion engine. The bracket assembly is adapted to be mounted on an associated watercraft. The bracket assembly supports the drive unit for pivotal movement about a generally horizontally extending tilt axis. A hydraulic tilt system is arranged to tilt the drive unit up and down. The tilt system includes a hydraulic pump and an electric motor that is capable of actuating the hydraulic pump. A relay unit supplies electric power to the electric motor based upon a control signal. The relay unit is disposed generally between the engine and the bracket assembly.

In accordance with another aspect of the present invention, an outboard motor comprises a drive unit and a bracket assembly. The drive unit has an internal combustion engine. The bracket assembly is adapted to be mounted on an associated watercraft. The bracket assembly supports the drive unit for pivotal movement about a generally horizontally extending tilt axis. The engine includes an air intake passage through which an air charge can be introduced to the combustion chamber. An exhaust passage receives exhaust gases from the combustion chamber. Both the air intake passage and the exhaust passage are disposed on the same side of the engine. At least two engine fixtures are disposed on the opposite side of the engine. The two engine fixtures comprise a large fixture and a small fixture. The small fixture is positioned closer to the bracket assembly than the large fixture.

In accordance with a further aspect of the present invention, an outboard motor comprises a drive unit and a bracket assembly. The drive unit has an internal combustion engine. The bracket assembly is adapted to be mounted on an associated watercraft and supporting the drive unit for pivotal movement about a generally horizontally extending tilt axis. A cover member covers over the engine at least in part. The engine includes a fuse unit arranged to contain at least one fuse. A fuse puller with which the fuse can be replaced is detachably affixed to the cover member.

In accordance with a still further aspect of the present invention, an outboard motor comprises a drive unit and a bracket assembly. The drive unit has an internal combustion engine. The bracket assembly is adapted to be mounted on an associated watercraft. The bracket assembly supports the drive unit for pivotal movement about a generally horizontally extending tilt axis. The engine included at least one combustion chamber. An air induction conduit communicates with the combustion chamber. A control valve is disposed within the air intake conduit. The control valve is adapted to adjust the air charge flow rate. A valve actuator is connected to the air intake conduit and is adapted to actuate the control valve when the atmospheric temperature is lower than a preset value.

For purposes of summarizing the invention and the advantages achieved over the prior art, certain objects and advantages of the invention have been described above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein. Further aspects, features and advantages of this invention will become apparent from the detailed description of the preferred embodiment which follows.

BRIEF DESCRIPTION OF THE DRAWINGS

These and other features of this invention will now be described with reference to the drawings of a preferred embodiment which is intended to illustrate and not to limit the invention. The figures will now be described.

DETAILED DESCRIPTION OF THE PREFERRED EMBODIMENT OF THE INVENTION

Figure 1:
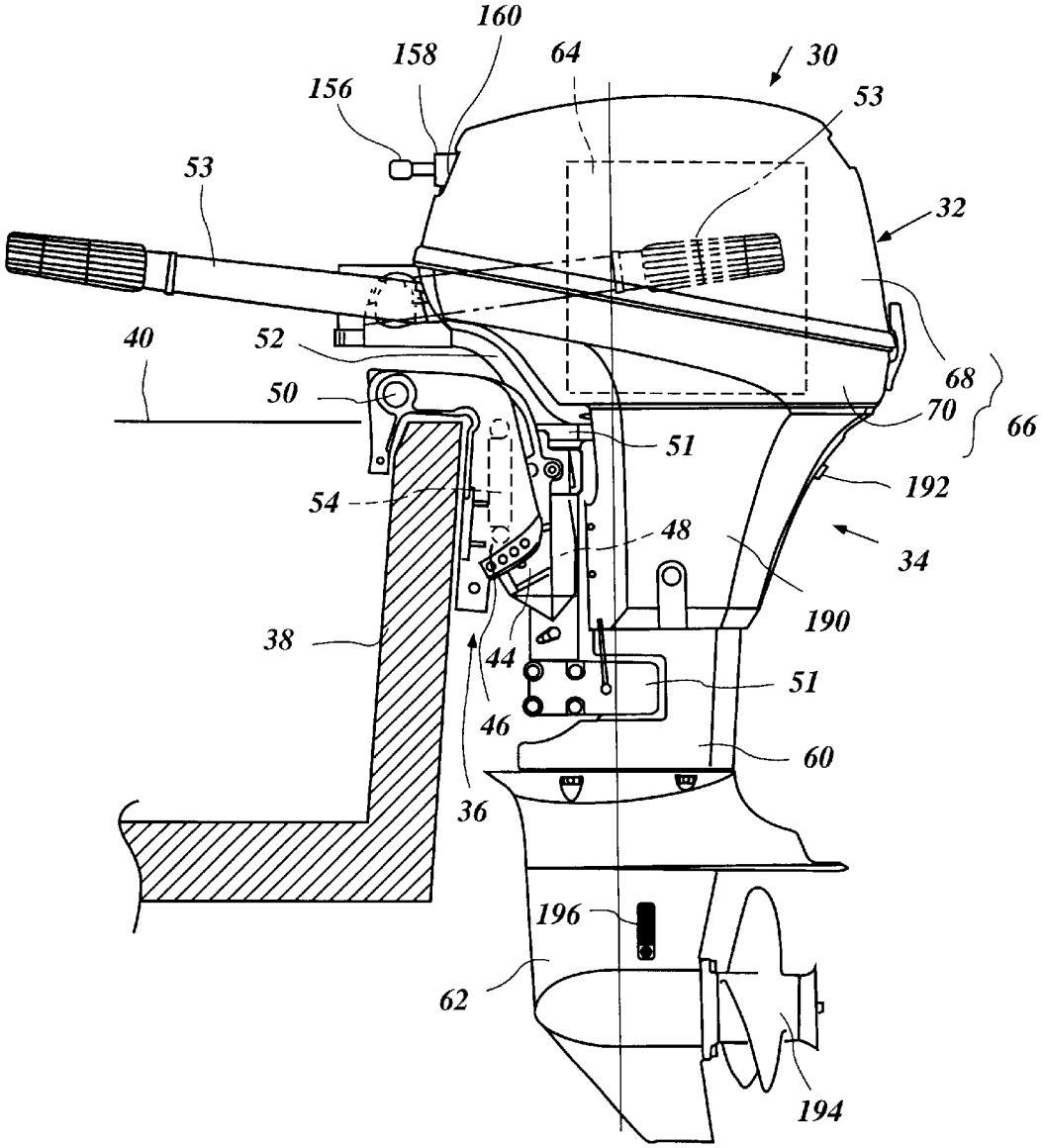
FIG. 1 is a side elevational view of an outboard motor having a power head configured in accordance with certain features, aspects and advantages of the present invention. An associated watercraft is partially shown in section.

With initial reference to FIG. 1, an outboard motor 30 having a power head 32 configured in accordance with certain features, aspects and advantages of the present invention is illustrated therein. The outboard motor 30 generally comprises a drive unit 34 and a bracket assembly 36.

The bracket assembly 36 supports the drive unit 34 on a transom 38 of an associated watercraft 40 so as to place a marine propulsion device of the drive unit 34 in a submerged position with the watercraft 40 floating in a body of water. The bracket assembly 36 comprises a swivel bracket 44, a clamping bracket 46, a steering shaft 48 and a pivot pin 50.

The steering shaft 48 extends through the swivel bracket 44 and is affixed to the drive unit 34 by mount assemblies 51. The steering shaft 48 is pivotally journaled within the swivel bracket 44 for steering movement about a generally vertically extending steering axis. A steering bracket 52 extends upwardly and forwardly from the steering shaft 48 and a foldable steering handle 53 is connected to the steering bracket 52. When the steering handle 53 is extended forwardly, the operator can steer the drive unit 34 through movement of the steering handle 53 about the steering axis that extends through the steering shaft 48. The handle 53 can be folded aside the power head 32 during storage or periods of non-operation.

The clamping bracket 46 includes a pair of bracket arms spaced apart from each other and affixed to the watercraft transom 38. The pivot pin 50 completes a hinge coupling between the swivel bracket 44 and the clamping bracket 46. The pivot pin 50 extends through the bracket arms so that the clamping bracket 46 supports the swivel bracket 38 for pivotal movement about a generally horizontally extending tilt axis of the pivot pin 50.

As used through this description, the terms "front," "fore," "forward" and "forwardly" mean at or to the side where the clamping bracket 46 is located, and the terms "reverse," "aft," "rear," "rearward" and "rearwardly" mean at or to the opposite side of the front side, unless indicated otherwise. Additionally, the term "engine fixture(s)", which will be used extensively below, may include any members, components and equipment that are attached on outer surface of the engine or disposed adjacent thereto for use in engine operations.

The bracket assembly 36 also can include a hydraulic tilt and trim adjustment system that is provided between the swivel bracket 44 and the clamping bracket 46. Various arrangements of the hydraulic tilt system are well known in the art and can be readily interchanged with the illustrated arrangement. In addition, while typical hydraulic tilt systems provide both tilt and trim adjustment movements, it is envisioned that certain features, aspects and advantages of the present invention can be retained in a system that provides either one of these movements. In the illustrated arrangement, a cylinder 54 is affixed to the clamping bracket 46 at its bottom end. A piston is slidably supported in an internal cavity of the cylinder 54. A piston rod is affixed to the piston such that the rod extends beyond one end of the cylinder 54. The end extending from the cylinder 53 is connected to the swivel bracket 44. A working fluid fills upper and lower chambers, which chambers are defined within the internal cavity of the cylinder 54. A powering device selectively pressurizes the working fluid within one or the other of the upper and lower chambers to effect movement of the piston rod.

In the illustrated arrangement, the powering device comprises a reversible hydraulic pump and a reversible electric motor that actuates the pump in either direction. The electric motor is supplied with electric power from a power source such as a generator or a battery through suitable circuitry. In the illustrated arrangement, the power is supplied to the motor from a generator via a tilt relay unit 58. that operates based upon a control signal which will be given by the operator with a conventional control device. For instance, in some arrangements, the signal is given when the operator pushes a switch button of the control device. The hydraulic tilt system, thus, tilts the drive unit up and down and adjusts the trim position of the drive unit 34 by changing flow directions and amounts of the working fluid under control of the control device.

With reference again to FIG. 1, the illustrated drive unit 34 comprising the power head 32, a driveshaft housing 60 and a lower unit 62. The power head 32 is disposed atop the drive unit 34 and includes an internal combustion engine 64 and a protective cowling assembly 66. The protective cowling assembly 66 includes a top cowling member 68 and a bottom cowling member 70. The cowling assembly 66 generally encases the engine 64. That is, the cowling assembly 66 generally defines a closed protective cavity that contains the engine 64.

Figure 4:
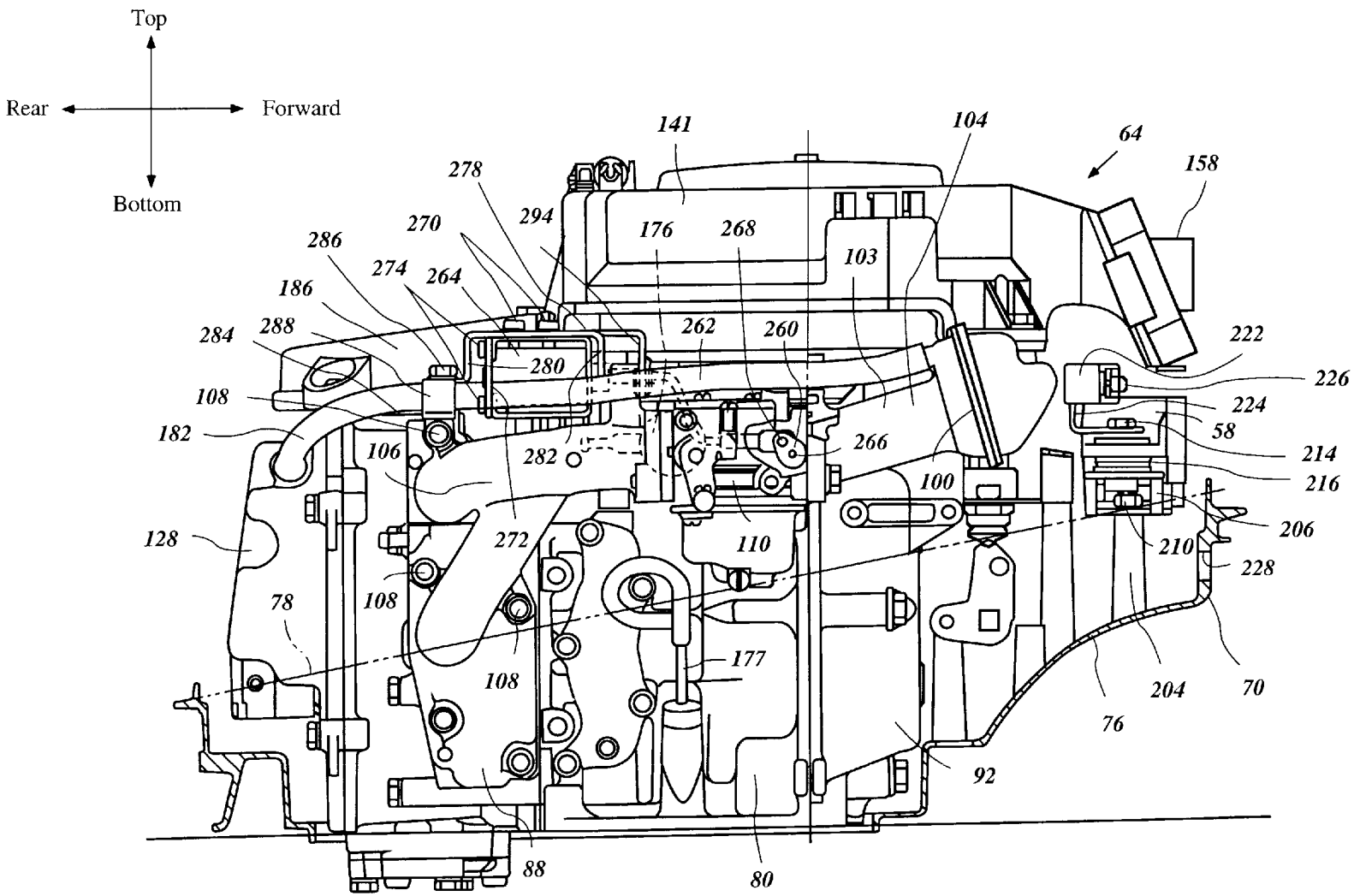
FIG. 4 is a side elevational view of the power head viewed from the starboard side. The top cowling member is detached and the bottom cowling member is shown in section. Part of a carburetor is also shown in section. Additionally, an air intake opening of the top cowling member is schematically shown.
Figure 5:
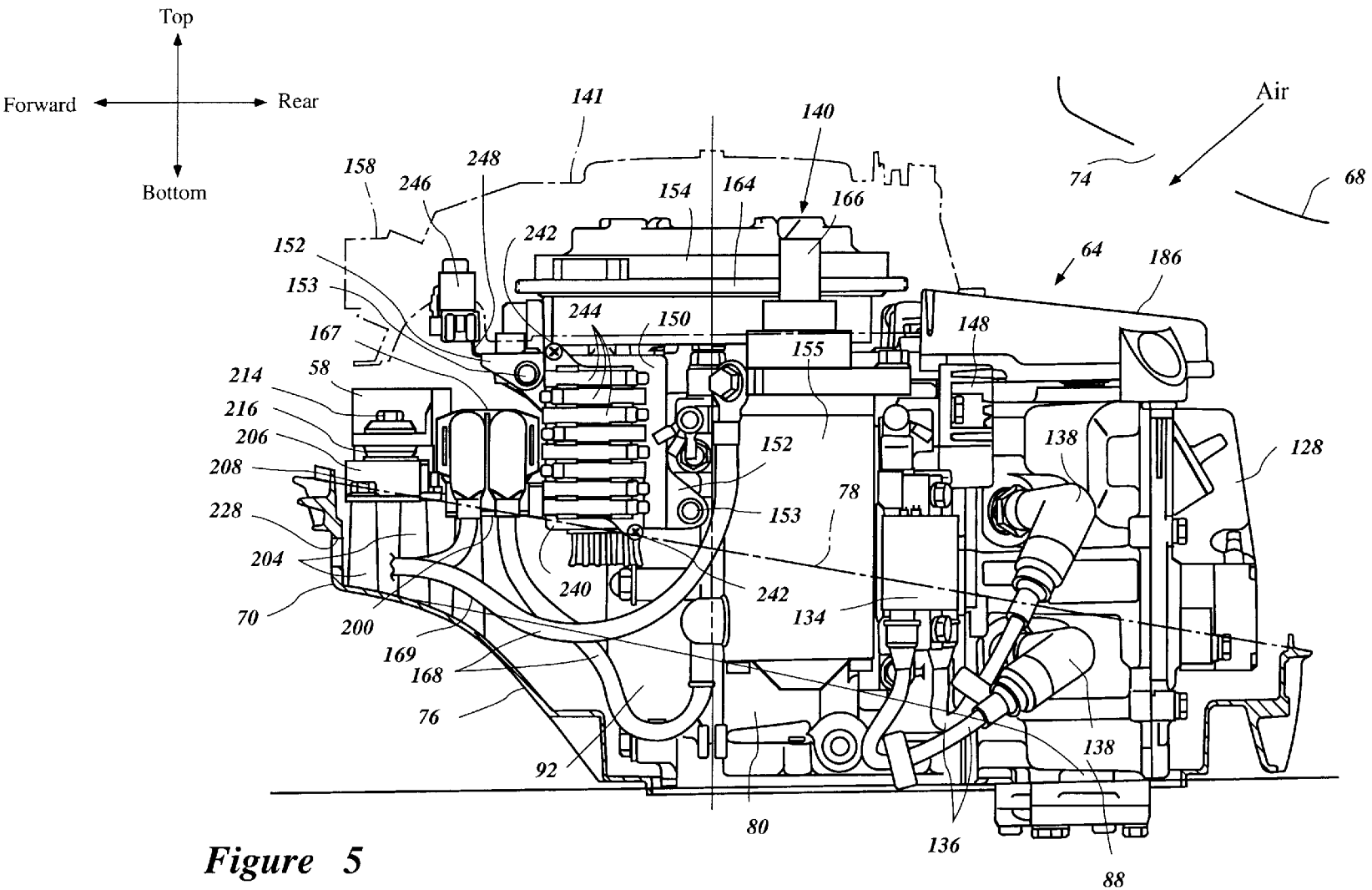
FIG. 5 is a elevational view of the power head viewed from the port side. The top cowling member is detached and the bottom cowling member is shown in section. Additionally, an air intake construction of the top cowling member is schematically shown.

The top cowling member 68 preferably is detachably affixed to the bottom cowling member 70 so that the operator can access the engine 64 for maintenance or other purposes. The top cowling member 68 is provided with an air intake construction that desirably has an air intake opening 74, which is schematically shown in FIG. 4 and 5, on the rear side of the top cowling member 68. The air intake construction introduces the ambient air into the cavity through the opening 74. The ambient air is introduced to the engine for combustion and also circulates within the cowling.

The bottom cowling member 70 has an opening extending through a lower portion. An exhaust guide member extends through the opening. The exhaust guide member is affixed atop the driveshaft housing 60. The bottom cowling member 70 and the exhaust guide member, thus, generally form a tray. The engine 64 is placed on this tray and is affixed to the exhaust guide. The exhaust guide also has an exhaust passage that forms a portion of an exhaust system.

Figure 3:
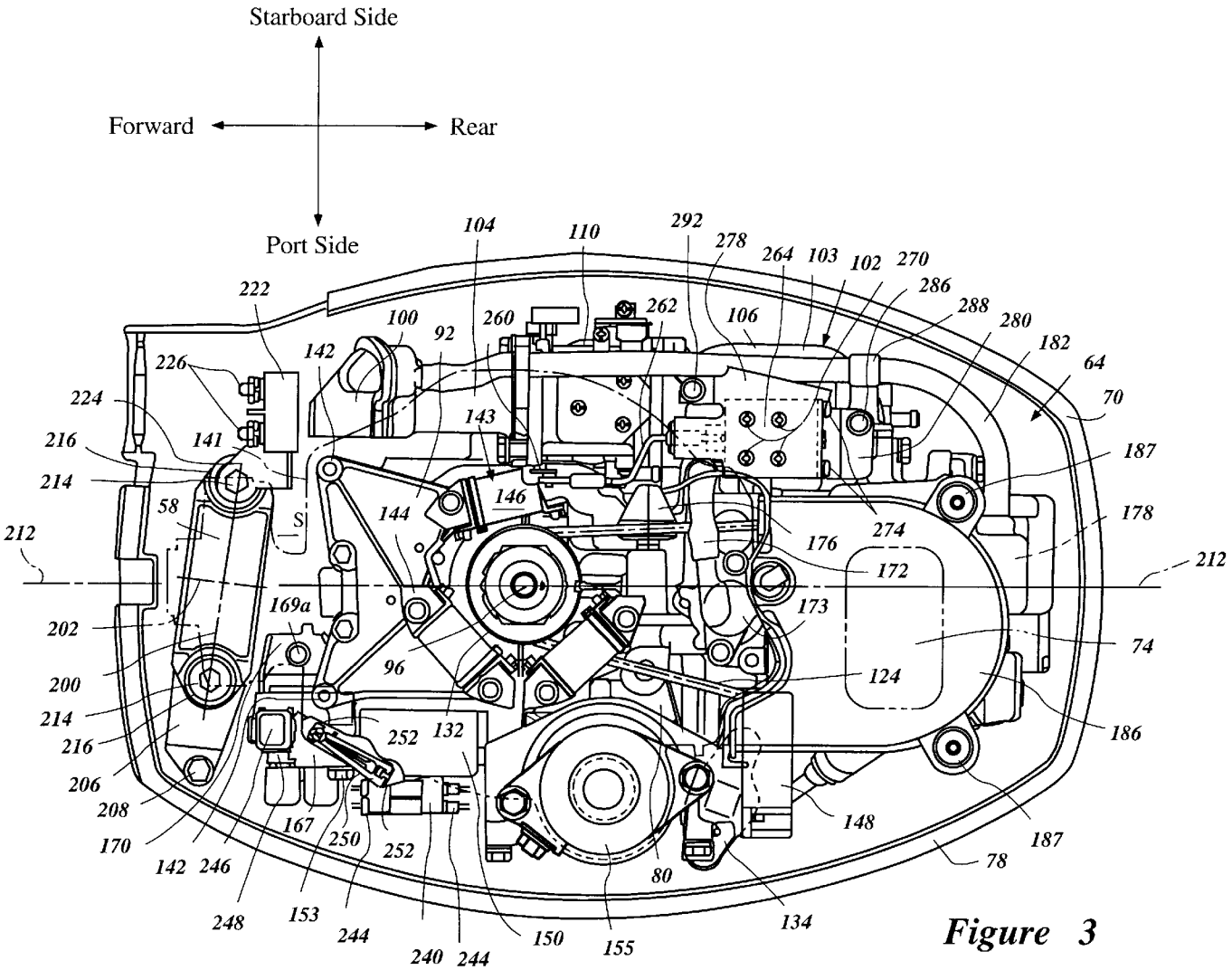
FIG. 3 is a top plan view of the power head. To simplify the illustration, a top cowling member, a main protective cover member, a flywheel and a recoil starter are removed from this figure. The main protective cover member, however, is shown in broken lines except for a fuse puller holding portion of the cover member. The fuse puller holding portion of the cover member is shown in solid line.

With reference to FIG. 3, the illustrated bottom cowling member 70 generally has a barrel-like configuration when viewed from the top. In this configuration, the center portion is widest and both the forward and rear portions gradually taper relative to the center portion. The top cowling member 68 preferably has a corresponding configuration. Also, with reference to FIGS. 4 and 5, a forward portion 76 of the bottom cowling member 70 has a forward bottom surface 76 that slants upward toward the bracket assembly 36 when viewed from the side. Also, a top edge surface 78 of the bottom cowling member 70 also slants in the same direction so that a forward end of the top edge surface 78 is disposed vertically higher than a rear end of the top edge surface 78. The slanting top edge is represented in FIGS. 4 and 5 with a phantom line.

The engine 64 preferably operates on a four-stroke combustion principle and powers a propulsion device. The engine 64 comprises a cylinder body or block 80. In the illustrated arrangement, the cylinder body 80 defines two cylinder bores 82 that extend generally horizontally and that are spaced generally vertically relative to each other. In other words, the engine 64 is an L2 (in-line 2 cylinder) type. This type of engine, however, is merely exemplary of a type in which various features, aspects and advantages of the present invention can be used. Other types of engines that have other numbers of cylinders or other cylinder arrangements and that operate on other combustion principles (e.g., crankcase compression two-stroke or rotary) are all practicable. In addition, while many features, aspects and advantages will be discussed relating to a counter-flow engine configuration, it should be noted that the engine can have a configuration other than the counter-flow configuration while retaining certain features, aspects and advantages of the present invention.

With reference again to FIG. 2, a cylinder liner 84 can be inserted within each cylinder of the cylinder body 80 to define each cylinder bore 82. Thus, the term "cylinder bore" as used herein means a surface of this cylinder liner 84. A piston 86 can reciprocate in each cylinder bore 82. A cylinder head member 88 is connected to one end of the cylinder body 80 to define two combustion chambers 90 with the pistons 86 and the cylinder bores 82. The other end of the cylinder body 80 is closed with a crankcase member 92 that defines a crankcase chamber 94 with the cylinder bores 82. An output shaft or crankshaft 96 extends generally vertically through the crankcase chamber 94. The pistons 86 are connected to the crankshaft 96 with connecting rods 98 and the crankshaft 96 rotates as a result of the reciprocal movement of the pistons 86. The crankcase member 92 preferably is located at the most forward position of the powerhead 32 and the cylinder body 80 and the cylinder head member 88 preferably extend rearwardly from the crankcase member 92. This configuration results in an advantageous weight distribution in the outboard motor.

The engine 64 includes an air induction system and an exhaust system. The air induction system is arranged to supply air charges to the combustion chambers 90 and comprises an air intake section 100 and air intake conduits 102 that are disposed on the starboard side of the engine 64. Preferably, a single common intake runner 104, which extends from the air intake section 100, defines an upstream portion of the air intake conduits 102. In addition, an air intake manifold 106 preferably defines a downstream portion of the intake conduits 102. The intake manifold 106 is split in a downstream location and each of the diverging branches connects to a corresponding inner intake portion which is formed internally in the body of cylinder head member 88. The intake manifold 106 preferably is made of aluminum alloy material and desirably is affixed to the cylinder head member 88 by bolts 108.

In the illustrated arrangement, the intake section 100, the intake conduits 102 and the inner intake portions together define a set of air intake passages 103. The inner intake portions include intake ports that connect to the respective combustion chambers 90. Intake valves are provided to open and close the intake ports. When the intake ports are opened, the air intake passages communicate with the combustion chambers 64.

Carburetors or air/fuel charge formers 110 desirably are interposed between the intake runner 104 and the intake manifold 106 to supply an air/fuel charge to the combustion chambers 90. The carburetors 110 generally comprise air passages that also define part of the air intake passages 103. As is well known, each carburetor 110 includes a throttle valve disposed within the air passage to control the throughput of air in response to desired engine performance characteristics.

A fuel supply tank can be located on the watercraft 40 and the carburetors 110 preferably are coupled to the fuel supply tank through fuel conduits. Fuel is pumped or drawn into the carburetors 110 and a desired amount of the fuel is mixed with the air passing through the air passages within the carburetor. An air/fuel charge, thus, is formed in the carburetors 110. The engine 64, of course, can include a fuel injection system (either direct or indirect) in the place of the carburetors, which are shown as one type of charge formers that can be employed.

Figure 2:
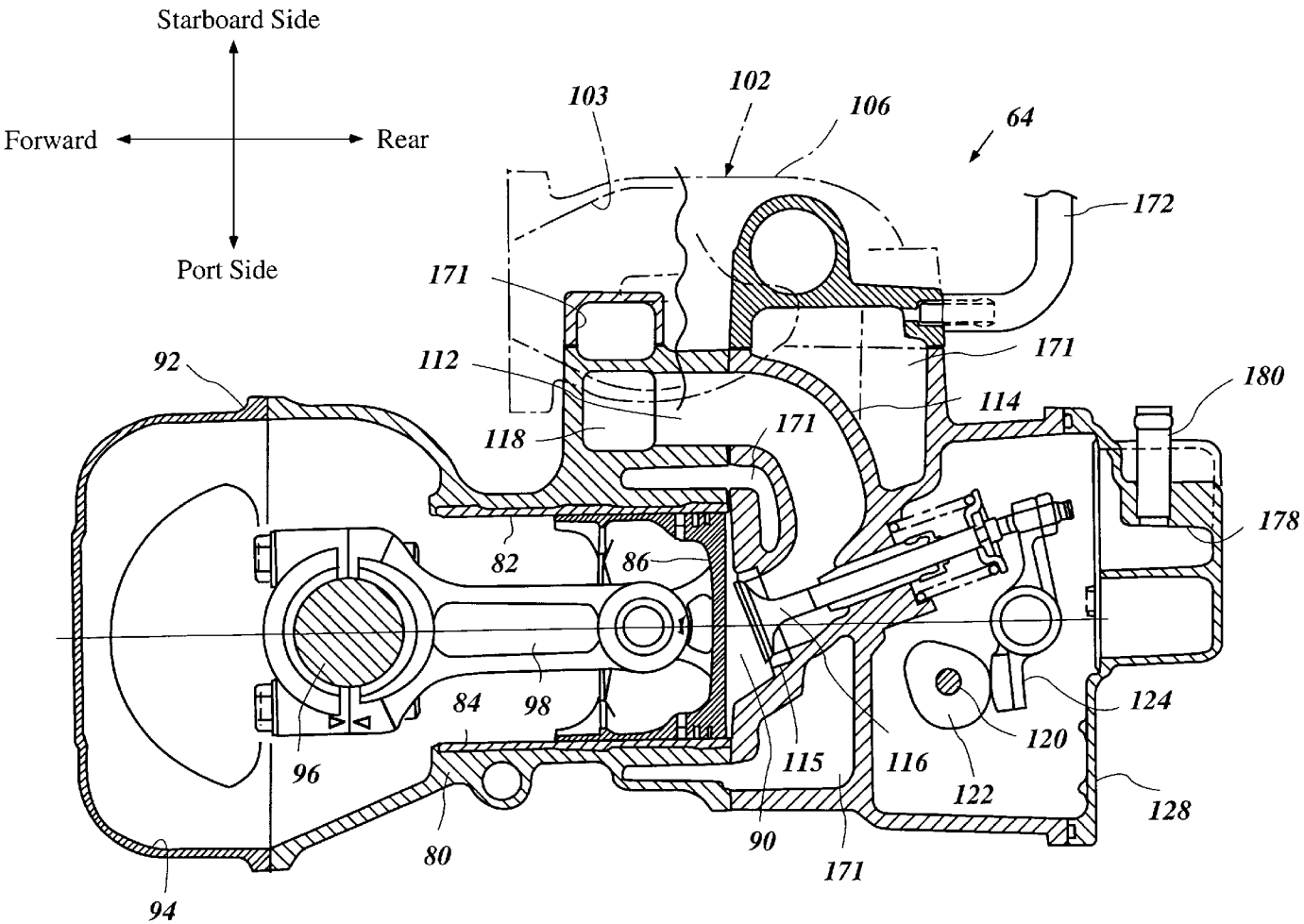
FIG. 2 is a schematic top plan sectioned view of an engine that is used in the outboard motor. An air intake conduit is shown in broken lines.

The exhaust system is arranged to discharge exhaust gases from the combustion chambers 90 to a location outside of the outboard motor 30. In the illustrated arrangement, the exhaust system has an exhaust passage 112 extending along the starboard side. Thus, the exhaust passages 112 advantageously are positioned on the same side of the engine as the air intake passages 103 which results in a counter-flow arrangement. With reference to FIG. 2, the exhaust passage 112 for each cylinder bore 82 preferably is positioned below the corresponding intake passage 103.

With reference now to FIG. 2, a set of inner exhaust portions 114 including exhaust ports 115 are formed in the cylinder head member 88. Exhaust ports 115 of each combustion chamber 90 are positioned below intake ports thereof. The exhaust portions 114 connect to the respective combustion chambers 90 through the exhaust ports 115. Exhaust valves 116 are provided to open and close the exhaust ports 115. When the exhaust ports 115 are opened, the combustion chambers 90 communicate with the exhaust passages 112. The inner exhaust portions 114 also connect to an exhaust manifold 118 that gathers exhaust gases coming from the respective exhaust portions 114. The exhaust manifold 118 preferably is unitary with the cylinder body 80 and extends generally vertically down to the exhaust passage of the exhaust guide member such that all the exhaust gases are directed downstream in the exhaust system toward the atmospheric or under-water outlet.

Preferably, a camshaft mechanism is provided to drive the intake valves and the exhaust valves 116. In the illustrated arrangement, a single camshaft 120 is journaled on the cylinder head member 88 and extends generally vertically. The camshaft 120 actuates the intake valves and the exhaust valves 116 through the use of a set of cam lobes 122. For example, rocker arms 124 are interposed between the cam lobes 122 and the respective exhaust valves 116 to push the valves 116 and to open the exhaust ports as desired. Preferably, a return mechanism (e.g., a spring or a pneumatic hydraulic lifter) bias the exhaust valves 116 closed. It should be understood that the intake valves, which are not illustrated, are actuated in a similar manner. A cylinder head cover member 128 is affixed to the cylinder head member 88 to define a camshaft chamber 130 therebetween.

The camshaft 122 is driven by the crankshaft 96. The camshaft 122 has a sprocket and the crankshaft 96 also has a sprocket 132. A timing belt or chain 124 is wound around the sprockets. Thus, the camshaft 122 rotates with the rotation of the crankshaft 96.

The engine 64 also includes an ignition system. In the illustrated arrangement, two spark plugs are affixed on the cylinder head member 88 such that a sparking member (i.e., electrode) of each of the spark plugs is exposed within the respective combustion chambers 90. An ignition coil unit 134 is mounted on the port side surface of the illustrated engine 64 and is secured to a portion of the cylinder body 80 adjacent to the cylinder head member 88. A pair of ignition cables 136 connect the ignition coil unit 134 with the respective spark plugs through coupling members 138. The spark plugs ignite the air/fuel charge contained within the combustion chambers 90 as desired. The timing can be controlled in any suitable manner.

With reference to FIGS. 3 and 5, a flywheel assembly 140 is affixed atop the illustrated crankshaft 132. A main protective cover member 141 (shown in phantom lines in FIG. 3) covers not only the flywheel assembly 140 but also the sprocket 132 of the crankshaft 96 and at least a major portion of the cylinder body 80 and the crankcase member 92. The protective cover member 141 is affixed to the top surface of the cylinder body 80 and the crankcase member 92 at three portions with, for example, bolts in the illustrated arrangement. Although not shown, one of the portions preferably is positioned at the cylinder body 80 and FIG. 3 shows the other two portions 142 positioned at the crankcase member 92.

As noted above, the flywheel assembly 140 includes the generator that supplies electric power to the firing system and other electrical equipment. A flywheel of the flywheel assembly 140 is formed as an inverted saucer-like shape and has a plurality of magnets affixed to the inner side surface of the flywheel. These magnets define part of the generator and rotate around starters or armatures, which define another part of the generator, when the crankshaft 132 drives the flywheel assembly 140 so that the armatures generate the electric power. The magnets act as not only part of the generator but also as a flywheel weight as is well known. Each armature comprises an armature core and a coil member wound around the armature core. The armatures are mounted on the cylinder body 80 so as to be generally surrounded by the magnets of the flywheel.

With reference to FIG. 5, a rectifier-regulator unit 148 is provided to rectify the generated power, which is AC power, to DC power and also to regulate the voltage of the generated power to a preset value. The DC power is transferred to a battery and is used by the electric equipment through the battery, or is directly supplied to some electrical devices for use. The rectifier-regulator 148 is likely to accumulate heat and thus needs to be cooled efficiently. In the illustrated arrangement, the rectifier-regulator unit 148 is placed generally above the ignition coil unit 134 but is slightly off-set toward the cylinder head member 88, and is connected to both the cylinder body 80 and the cylinder head member 88 in the illustrated arrangement. The air intake opening 74 of the top cowling member 68 advantageously is disposed adjacent to the rectifier-regulator 148 such that a cooling air flow can be directed across the rectifier-regulator 148. Preferably, the rectifier-regulator is disposed generally between the opening 74 and an inlet to the induction system such that the air stream can be used to cool the rectifier-regulator 148 to some degree. Also, in the illustrated arrangement, no engine fixture is provided between the air intake opening 74 and the rectifier-regulator 148 such that the flow of air is unimpeded or unobstructed. Air introduced through the opening 74 into the cowling cavity, therefore, can flow around the rectifier-regulator 148 smoothly and cool it efficiently.

The flywheel assembly 140 further includes an igniter coil and a pulsar coil. The igniter coil is generally the same as the armature 143. In some applications, one of the armatures 143 can act as the igniter coil. The pulsar coil also resembles the armature 143 except for that its coil member is relatively smaller than that of the armature 143. The igniter and pulsar coils are connected to a CDI (Capacitor Discharge Ignition) unit 150 and provide input signals to the CDI unit 150. The CDI unit 150 includes a capacitor, thyristor and diode for each cylinder. The capacitor is coupled to the ignition system through the ignition coil unit 134. An output of the igniter coil is rectified by the diode and charged in the capacitor. In the meantime, the pulsar coil generates a pulse at a firing timing. The pulse activates the thyristor to abruptly discharge the accumulated capacitor toward the ignition coil in the ignition coil unit 134. The ignition coil, therefore, generates a high voltage output to make a spark at the spark plug. Since the firing principle by the CDI unit 150 is well known in the art, further description of the unit is not believed necessary to permit those skilled in the art to practice the invention. The CDI unit 150 in the illustrated arrangement is mounted on the portside surface of the engine 64 with unified stays 152 that are connected to the cylinder body 80 and the crankcase member 92 by bolts 153. The protective cover member 141 also covers the CDI unit 150 in the illustrated arrangement.

In the illustrated arrangement, the flywheel assembly 140 additionally includes a recoil or manual starter 154 and a starter motor 155 so that the operator can select a manual start by the recoil starter 154 or a mechanical start by the starter motor 155. The recoil starter 154 includes a starter rope wound generally around the flywheel or an associated starter drum. A free end of the starter rope is provided with a starter handle 156 (see FIG. 1) that extends outwardly and forwardly through a starter handle holder portion 158 of the protective cover member 141. The starter handle holder portion 158 itself extends outwardly and forwardly through a starter opening 160 that is formed at a forward and upper portion of the top cowling member 68. The operator, thus, can pull the starter handle 156 to actuate the recoil starter 154. When the operator pulls the starter handle 156, the starter rope rotates the crankshaft 96 and the engine 64 starts. The recoil starter 154 is well known in the art; accordingly, no further description is believed necessary to permit those skilled in the art to practice the present invention.

The flywheel has a ring gear 164 disposed about its periphery. The starter motor 155 is mounted on the port side surface of the illustrated engine 64 and generally is interposed between the ignition coil unit 134 and the CDI unit 150. The starter motor is connected to the cylinder body 80 in any suitable manner. The starter motor 155 comprises a starter gear 166 that is adapted to mesh with the ring gear 164. The starter motor 155 is in electrical communication with the battery through a starter relay unit 167, starter cables 168 and a starter button or main switch in the illustrate arrangement.

The starter button is provided at an appropriate location in the watercraft 40 or directly on a surface of the cowling assembly 66 to activate the starter motor 155. The button preferably is easily accessed and can be positioned on a forward-facing surface of the cowling assembly 66 in some applications.

With reference to FIGS. 3 and 5, a post 169, which is uniformly formed with the bottom cowling member 70, extends upwardly from an inner bottom surface of the bottom cowling member 70 and a stay 170 is affixed to the post 169 by a bolt 169*a*. The starter relay unit 167 is affixed to the stay 170. The starter relay unit 167 contains a relay element or electromagnetic element that will make a closed circuit from the battery to the starter motor 155 if the starter button is pressed. This relay element is a so-called non-contact switch in some arrangements.

When the operator, therefore, presses the starter button, the starter motor 155 drives the ring gear 164 with the gear 166 to start the engine 64. The starter motor 155 further includes a one-way clutch mechanism. Because of this, after the engine 64 has started, the starter gear 166 of the starter motor 155 no longer drives the ring gear 164. As is best seen in FIG. 3, the illustrated protective cover member 141 generally covers the starter motor 155 also.

The engine 64 further includes a water cooling system. Cooling water is introduced from the body of water surrounded by the outboard motor 30 by a water pump. The water is supplied to engine portions and exhaust passage portions, which will accumulate much heat during the engine operation, through water jackets. For example, portions of the water jackets can be seen in FIG. 2 and are indicated by the reference numeral 171.

With reference to FIG. 3, the water is then discharged to the body of water through, for example, a water discharge conduit 172. A thermostat is disposed in the thermostat chamber 173 formed at a most upstream portion of the discharge conduit 172 in the illustrated arrangement. The thermostat is a temperature operable water flow controller. When water temperature is lower than a preset temperature, the thermostat prevents or limits the volume of water from flowing downstream of the discharge conduit 172 so as to assist warming up of the engine 64.

The engine 64 also includes a lubrication system. A lubricant reservoir, which contains lubricant, preferably is provided within the driveshaft housing 60. A lubricant pump supplies lubricant to engine portions that require lubrication. After circulating in the engine, the lubricant returns to the lubricant reservoir. With reference to FIG. 3, a lubricant pressure sensor 176 is provided in the lubrication system to sense whether a sensed lubricant pressure is normal or abnormal. An ullage rod 177, which is seen in FIG. 4, is usually immersed in the reservoir so that the operator may check the lubricant level or see how dirty the lubricant is at any time. A lubricant filter is disposed within the lubricant reservoir.

The engine 64 additionally includes a ventilation system that transfers blow-by gases from the crankcase chamber 94 to the air induction system. The blow-by gases are initially transferred from the crankcase 94 to an oil separator or breather chamber 178 formed on the cylinder head cover member 128 through an inner passage. The oil separator 178 has a labyrinth structure to separate lubricant from the blow-by gases. The blow-by gases then pass to the air intake section 100 of the air induction system through an outlet 180 and a blow-by gas conduit 182 that is fitted to the outlet 180. The transferred blow-by gases will be introduced into the combustion chambers 90 with the air/fuel charge for combustion.

In the illustrated arrangement, an auxiliary cover member 186 is provided separately from the main cover member 186, and secured to both the cylinder head member 88 and the cylinder head cover member 128. With reference to FIG. 3, two affixing portions 187 are provided for securing the auxiliary cover member 186 in position. The auxiliary cover member 186 covers the cylinder head member 88 and the cylinder head cover member 128 including the sprocket of the camshaft 120.

With reference again to FIG. 1, the driveshaft housing 60 depends from the power head 32 and supports a driveshaft as well as the engine 64. The driveshaft extends generally vertically through the exhaust guide member and the driveshaft housing 60. The driveshaft also drives the water and oil pumps through suitable gearing. The driveshaft housing 60 also defines internal passages which form portions of the exhaust system and connect to the exhaust manifold 118. An idle exhaust passage extends from the internal passages and opens to the atmosphere above the body of water. In the illustrated arrangement, an apron 190 covers an upper portion of the driveshaft housing 60 to provide a neat appearance. Because the apron 190 is not a structural member, it preferably is made of synthetic resin or plastic. The idle exhaust passage preferably extends through an outer surface of the driveshaft housing 60 and the apron 190, and an idle exhaust outlet 192 of the idle exhaust passage extends beyond the apron 190 to open to the atmosphere.

The lower unit 62 depends from the driveshaft housing 60 and supports a propulsion shaft, which is driven by the driveshaft. The propulsion shaft extends generally horizontally through the lower unit 62 with the drive unit 34 in a tilted down, or operational, position. In the illustrated arrangement, the propulsion device includes a propeller 194 that is affixed to and driven by an outer end of the propulsion shaft. The propulsion device, however, can take the form of a dual, counter-rotating propeller system, a hydrodynamic jet, or any other suitable propulsion device.

A transmission is provided between the driveshaft and the propulsion shaft. The transmission couples together the two shafts, which lie generally normal to each other (i.e., at a 90° shaft angle), via a bevel gear assembly or the like. The transmission has a switchover or clutch mechanism to shift rotational directions of the propeller 194 among forward, neutral or reverse. The switchover mechanism is operable by the operator through a shift linkage. Because such linkages and transmissions are well known, further description is unnecessary.

The lower unit 62 has a water inlet 196 for the water cooling system. The water inlet 196 is coupled to the water pump through a water inlet passage. The water pump is then coupled to the water jackets including the jackets 170 as described above.

As described above, the lower unit 62 also defines an internal passage that forms a discharge section of the exhaust system. At engine speed above idle, the majority of the exhaust gasses are discharged toward the body of water through the internal passage and a hub of the propeller 194. At idle speed, the exhaust gases can be discharged through the idle exhaust passage such that the back pressure created by the water does not significantly exceed the normal pressure created within the exhaust system during idle.

With reference again to FIGS. 3 to 5, the tilt relay unit 58 for the hydraulic tilt system and other engine fixtures will now be described. Preferably, the tilt relay unit 58 is generally configured as an elongated rectangular and generally parallelepiped shape. The illustrated relay unit 58 is slender along one axis 200. That is, its width extending along an axis 202, which is normal to the axis 200, is shorter than its length extending along the axis 200. As used through this description and the claims, the axis 200 and the axis 202 will be referred to as "the long axis" and "the short axis", respectively. The tilt relay unit 58 contains relay elements, such as electromagnetic elements, for example, that can close a power circuit in response to the control signal that indicates that electric power should be supplied to the electric motor of the hydraulic tilt system from the battery. More specifically, the tilt relay unit 58 preferably includes tilt-up relay elements and tilt-down relay elements so as to activate the electric motor in both the tilt-up direction and the tiltdown direction.

In the illustrated arrangement, a pair of posts 204 (see FIG. 5) extend upwardly from an inner bottom surface of the bottom cowling member 70. The posts 204 preferably are uniformly formed with the bottom cowling member 70 and spaced apart from each other transversely in front of the crankcase member 92. A stay 206 desirably extends between these posts 204. The illustrated stay 206 is generally configured as a rectangular wave shape. One end of the stay 206 (i.e., the end on the port side) is affixed to one of the posts 204 disposed on the same side with a bolt 208. The other end of the stay 206 (i.e., the end on the starboard side) is affixed to the other post 204 with a bolt 210. Thus, the illustrated tilt relay unit 58 extends generally transversely between the posts 204. That is, the relay unit 58 is positioned between the engine 64 and the bracket assembly 36 and the long axis 200 of the relay unit 58 extends substantially normal to an axis 212 of the engine 64 extending fore and aft thereof. Preferably, the end portion of the tilt relay unit 58 on the port side is positioned slightly more forward than the end portion on the starboard side. The relay unit 58 preferably is affixed to the stay 206 by bolts 214 and is supported by elastic members 216 made of rubber material. The elastic members 216 reduce vibration transmission from the engine 64 to the relay elements in the relay unit 58. Depending upon the design of the relay elements, the relay elements can sometimes malfunction as a result of a high degree of engine vibration.

With reference to FIG. 3, a large portion of the illustrated tilt relay unit 58 is positioned beneath a front edge or projection part of the main cover member 141. Thus, water splash, if any, is inhibited from dropping onto the relay unit 58. Additionally, the cover member 141 also covers the starter motor 155 and the CDI unit 150. Thus, these components also are somewhat protected from splashing water.

With continued reference to FIG. 3, a terminal unit 222 is provided for connecting cables from the tilt relay unit 58 to the electric motor of the hydraulic tilt system. The illustrated terminal unit 222 includes a unified stay 224 that is affixed to the top of the elastic member 216 on the starboard side by the bolt 214. The illustrated terminal unit 222 also includes a pair of terminals 226 which are coupled with each other within the unit 222. Although not shown, a cable from the relay unit 58 can be coupled to one of the terminals 226, while another cable, which extends to the hydraulic tilt system, is coupled to the other terminal 226. The latter cable preferably extends forwardly through a through-hole 228 that is sealed about the cable.

A two-way contact switch preferably is provided that the watercraft operator can access. The switch operates to control the relay and the hydraulic tilt system. For example, if the operator turns the switch to one contact, the tilt-up relay elements are activated to supply electric power to the motor to drive the hydraulic motor in the tilt-up direction. Accordingly, if the operator turns the switch to the other contact, the tilt-down relay elements are activated to supply electric power to the motor to drive the hydraulic motor in the tilt-down direction. The hydraulic tilt system, thus, tilts up or down the drive unit 34 under control of the operator. Of course, a three way toggle switch has been contemplated which provides three positions: up, neutral and down. Moreover, separate push button type switches have been contemplated such that one button corresponds to up and the other button corresponds to down and the motor is actuated so long as the button is depressed. It is envisions that other suitable arrangements also can be used.

In the illustrated arrangement, a space S is formed between the crankcase 92 and the tilt relay unit 58 (see FIG. 3). Some electric cables and shift members for the switchover mechanism are place in this space S. Thus, these components are contained in an internal passage and the cowling size can be decreased.

A coupler assembly 240, which is one of the engine fixtures, is disposed between the starter motor 155 and the starter relay unit 167 (see FIG. 3). The coupler assembly 240 preferably is placed generally vertically higher than the CDI unit 150 and above it so as to almost cover the CDI unit 150. In the illustrated arrangement, the CDI unit 150 has a pair of stays (i.e., on at opposite sides of its top and bottom portions). The coupler assembly 240 also preferably has a pair of stays at corresponding positions. The respective stays of the illustrated coupler assembly 240 are affixed to the corresponding stays of the CDI unit 150 by screws 242.

As seen in FIG. 3, the motor also includes a set of couplers 244 that are stacked on the coupler assembly 240. A number of electric cables, thus, can be connected with or disconnected from each other via the couplers 244. Because the coupler assembly 240 is exposed in this arrangement, the user or a service person can easily connect or disconnect them.

The engine 64 also has a fuse unit or fuse container 246 as another engine fixture. The fuse unit inhibits large levels of current from flowing through the electrical equipment. The fuse unit 246 may contain a plurality of fuses. The fuse unit 246 preferably is affixed to a stay 248 that is affixed to the crankcase member 92 together with the stay 152 of the CDI unit 150. With reference to FIGS. 3 and 5, the fuse unit 246 is positioned aside the main protective cover member 141 and is disposed generally higher than the other engine fixtures positioned on the port side. The user or service person, therefore, can find the fuse unit easily by detaching the top cowling 68.

In order to replace the fuses, usually a fuse puller 250 is used. The fuse puller 250 preferably is configured in a shape similar to tweezers so that the user or service person can replace a fuse that has broken with a new fuse by picking the fuses up between two tips of the fuse puller 250. In the illustrated arrangement, the fuse puller 250 is detachably secured to a top surface of the main protective cover member 141 adjacent to the fuse unit 246. A pair of holding projections 252 extend upwardly from the top surface of the cover member 141. The projections 252 are configured to allow the fuse puller 250 to be snap fit in a storage position. Thus, the fuse puller 250 is normally held by the projections and can be removed from them when the user or service person replaces the fuses.

With reference still to FIGS. 3 and 5, in the illustrated embodiment, the starter motor 155 is the highest and bulkiest engine fixture positioned on the port side. Because of this, the starter motor 55 is disposed at the center portion of the engine side. The CDI unit 150 and the coupler assembly 240, as combined, extend outward from the engine less than the starter motor 155 and also have a smaller overall height as compared to the starter motor 155. The combined CDI unit 150 and coupler assembly 240 are, however, larger than the starter relay unit 167 in height. The CDI unit 150, therefore, is positioned next to the starter motor 155 and the starter relay unit 167 is then placed next to the CDI unit 150. This allows the advantageously streamlined configuration of the cowling assembly 66 described above.

With reference to FIG. 5, each bottom surface of the stay 206 for the tilt relay unit 58, the starter relay unit 167, the CDI unit 150 and the coupler assembly 240 is generally even with the top edge surface 78 of the bottom cowling member. In other words, the tilt relay unit 58 and the engine fixtures 150, 167, 240 are generally placed within a cavity defined by the top cowling member 68. This arrangement is advantageous because each of these members and units, including the tilt relay unit 58, can be placed above the bottom cowling member 70. Such a location makes the maintenance and replacement of these units much easier.

Returning to the induction system, the throttle valve is provided with a choking mechanism in the illustrated arrangement. The choking mechanism actuates the throttle valve in the air induction system when the atmospheric temperature is lower than a predetermined level. This mechanism is useful for cold start as is well known in the art.

With reference to FIG. 4, the illustrated choking mechanism comprises a first link member 260, a second link member 262 and a choke solenoid unit 264. The first link member 260 is pivotally mounted on a side surface of the carburetor 110 and is connected to the throttle valve by a first shaft 266. The second link member 262 is pivotally connected to the first link member 260 by a second shaft 268 at one end. The other end of the second link member 262 is connected to a solenoid element or an electromagnetic element that is disposed within the solenoid unit 264. The second link member 262 is capable of reciprocation when the solenoid element is actuated. A choke button is placed in a convenient location, such as in the watercraft 40 or on a forward surface of the outboard motor 30. The choke button receives power from a power supply circuit and selectively allows a user to close the circuit to connect the solenoid element to the battery. For instance, when the operator pushes the button, electric power is supplied to the choke solenoid to actuate the second link member 262. The reciprocal movement of the second link member 262 moves the first link member 260 pivotally relative to the carburetor body. The throttle valve, hence, pivots within the intake passage of the carburetor 110 so as to generally close the passage. Accordingly, the air amount is extremely reduced relative to the fuel amount. This makes the air/fuel ratio small and helps cold start the engine 64.

The choke solenoid unit 264 preferably is sub-assembled with a U-shaped member 268 by screws 270. A flat member 272 is further provided to complete an enclosure of the solenoid unit 264 with the U-shaped member 268 in the illustrated arrangement. Screws 274 fix the flat member 272 to the U-shaped member 268. The sub-assembly of the solenoid unit 264 can be affixed to the top surface of the intake manifold 106 via a stay 278. The stay 278 can include at least two mounting portions 280, 282. One of the portions 280 preferably is affixed to a first connecting portion 284, which extends upwardly from the intake manifold 106 substantially at one end, by a bolt 286. The blow-by gas conduit 182 desirably is connected to the first connecting portion 284 together with the stay portion 280 via a stay 288. The other portion 282 is secured to a second connecting portion 290, which extends upwardly from the intake manifold 106 at is forward end, by bolt 292. This construction is concealed in FIG. 4 by the blow-by gas conduit 182. Preferably, the stay 278 includes a support portion 294 that supports the second link member 262.

As indicated above, the intake manifold 106 preferably is a rigid member made of aluminum alloy. Advantageously, the intake manifold 106, therefore, does not generate substantial vibrations that may negatively impact the solenoid unit 264. In addition, the illustrated solenoid unit 264 is positioned on a top surface of the manifold 106 such that the balance of the choke mechanism can be compactly arranged in a desired location along the side of the engine. In this position, for instance, the link members 260, 262 are well protected by the induction system.

As described above, in the illustrated arrangement, the tilt relay unit 58 is disposed between the engine 64 and the bracket assembly 36. Thus, even the counter-flow type engine can employ the disclosed tilt relay unit 58 while maintaining good component balance and positioning. Also, the counter-flow engine configuration can be assembled such that the previously identified excess space defined opposite the intake and exhaust passages can be effectively filled with other engine fixtures. Moreover, the particular illustrated configuration allows the largest fixture, i.e., starter motor 155 to be positioned at the center of the cowling assembly 66 and while smaller fixtures, such as the CDI unit 150 and the starter relay unit 167, are positioned next to one another in compliance with the preferred configuration of the cowling assembly 66. Furthermore, in accordance with other aspects of the present invention, a fuse puller 250 can be detachably secured to the protective cover member 141. Thus, the user or service person can quickly and easily locate the fuse puller 250.

Although the present invention has been described in terms of a certain preferred embodiment, other embodiments apparent to those of ordinary skill in the art also are within the scope of this invention. Thus, various changes and modifications may be made without departing from the spirit and scope of the invention. Moreover, not all of the features, aspects and advantages are necessarily required to practice the present invention. Accordingly, the scope of the present invention is intended to be defined only by the claims that follow when reasonably construed in light of this specification as understood by those of ordinary skill in the art.

What is claimed is:

1. An outboard motor comprising a drive unit including an internal combustion engine, a bracket assembly adapted to be mounted on an associated watercraft to support the drive unit for pivotal movement about a generally horizontally extending tilt axis, and a hydraulic tilt system arranged to tilt the drive unit, the tilt system including a hydraulic pump, an electric motor actuating the hydraulic pump, a relay unit selectively supplying electric power to the electric motor based upon a control signal, the relay unit being disposed generally between the engine and the bracket assembly, a protective cowling surrounding both the engine and the relay unit, and a cover member extending over at least a portion of the engine and the relay unit, the engine including a fuse container furnished on the engine and arranged to contain at least one fuse, and a fuse puller with which the fuse can be replaced being detachably affixed to the cover member.

2. The outboard motor as set forth in claim 1, wherein the cover member has a fuse puller holding portion arranged to detachably hold the fuse puller.

3. The outboard motor as set forth in claim 2, wherein the fuse puller holding portion is disposed adjacent to the fuse container.

4. An outboard motor comprising a drive unit including an internal combustion engine, the engine including at least one combustion chamber, an air intake conduit defining an air intake passage through which an air charge is introduced to the combustion chamber, a control valve disposed within the air intake conduit for adjusting an amount of the air charge, and a valve actuator affixed to the air intake conduit for actuating the control valve, a bracket assembly adapted to be mounted on an associated watercraft to support the drive unit for pivotal movement about a generally horizontally extending tilt axis, a hydraulic tilt system arranged to tilt the drive unit, the tilt system including a hydraulic pump, an electric motor actuating the hydraulic pump, a relay unit selectively supplying electric power to the electric motor based upon a control signal, the relay unit being disposed generally between the engine and the bracket assembly, and an atmospheric air temperature sensor, the valve actuator actuating the control valve when the sensed atmospheric air temperature is lower than a preset value.

5. An outboard motor comprising a drive unit having an internal combustion engine, a bracket assembly adapted to be mounted on an associated watercraft, the bracket assembly supporting the drive unit for pivotal movement about a generally horizontally extending tilt axis, a cover member extending over at least a portion of the engine, the engine including a fuse unit arranged to contain at least one fuse, and a fuse puller with which the fuse can be replaced being detachably affixed to an outer surface of the cover member.

6. The outboard motor as set forth in claim 5, wherein the cover member has a fuse puller holding portion arranged to detachably hold the fuse puller.

7. The outboard motor as set forth in claim 6, wherein the fuse puller holding portion is disposed adjacent to the fuse unit.

8. The outboard motor as set forth in claim 5, wherein the engine includes a manual starter assembly disposed vertically higher than an upper surface of the engine, the manual starter assembly adapted to start the engine started manually, and the cover member extending over at least a portion of the manual starter assembly.

9. An outboard motor comprising a drive unit including an internal combustion engine, a bracket assembly adapted to be mounted on an associated watercraft to support the drive unit for pivotal movement about a generally horizontally extending tilt axis, the engine including at least one combustion chamber, an air intake conduit introducing an air charge to the combustion chamber, a control valve disposed within the air intake conduit for adjusting an amount of the air charge, a valve actuator affixed to the air intake conduit for actuating the control valve, a control unit, and an atmospheric temperature sensor being connected to the control unit, the control unit operating the valve actuator to actuate the control valve when the atmospheric temperature sensed by the temperature sensor is lower than a preset value.

10. The outboard motor as set forth in claim 9, wherein the valve actuator is disposed above the air intake conduit.

* * * * *

UNITED STATES PATENT AND TRADEMARK OFFICE

CERTIFICATE OF CORRECTION

PATENT NO. : 6,500,036 B1 
DATED : December 31, 2002
INVENTOR(S) : Fukuoka et al.

It is certified that error appears in the above-identified patent and that said Letters Patent is hereby corrected as shown below:

Title page,
Item [56], References Cited, U.S. PATENT DOCUMENTS, should include the following patents:

| | | | |
|---|---|---|---|
| -- | 4,632,662 * | 12/86 | Handa |
| | 4,784,624 * | 11/88 | Yoshida |
| | 4,931,025 * | 6/90 | Torigai et al |
| | 5,049,100 * | 9/91 | Yamamoto et al |
| | 5,064,393 * | 11/91 | Inoue |
| | 5,105,334 * | 4/92 | Holinka |
| | 5,445,548 * | 8/95 | Koishikawa et al |
| | 5,713,772 * | 2/98 | Takahashi et al |
| | 5,989,085 * | 11/99 | Suzuki |
| | 6,036,557 * | 3/00 | Morikami |

Signed and Sealed this

Second Day of September, 2003

JAMES E. ROGAN
*Director of the United States Patent and Trademark Office*